United States Patent [19]

Schank

[11] 3,951,063

[45] Apr. 20, 1976

[54] PROCESS FOR PREPARING REVERSIBLE CURE WATERLESS LITHOGRAPHIC MASTERS

[75] Inventor: Richard L. Schank, Webster, N.Y.

[73] Assignee: Xerox Corporation, Stamford, Conn.

[22] Filed: Nov. 30, 1973

[21] Appl. No.: 420,402

[52] U.S. Cl. ..... 101/466; 101/150; 101/401.1; 101/450; 427/198; 427/207; 427/274; 428/447

[51] Int. Cl.[2] ..... B41C 1/10

[58] Field of Search ..... 161/206, 207, 208, 209; 117/161 ZA; 101/451, 452, 465, 466, 467, 401.1; 346/74 ES

[56] References Cited

UNITED STATES PATENTS

| | | | |
|---|---|---|---|
| 3,215,527 | 11/1965 | Johnson | 96/1 |
| 3,315,600 | 4/1967 | Tomanek | 101/467 X |
| 3,322,537 | 5/1967 | Giaimo | 117/17.5 X |
| 3,368,483 | 2/1968 | Storms | 101/463 X |
| 3,460,975 | 8/1969 | Stebleton | 117/161 ZA |
| 3,554,125 | 1/1971 | VanDorn et al. | 101/467 X |
| 3,589,290 | 6/1971 | Walkup et al. | 101/401.1 |
| 3,632,375 | 1/1972 | Gipe | 101/456 X |
| 3,647,510 | 3/1972 | Gagnon | 117/161 ZA |
| 3,650,797 | 3/1972 | Tomanek | 101/463 X |
| 3,676,420 | 7/1972 | Fulton et al. | 117/161 ZA |
| 3,677,178 | 7/1972 | Gipe | 101/450 |
| 3,840,393 | 10/1974 | Ishizaha et al. | 117/161 ZA |

OTHER PUBLICATIONS

Chemistry and Technology of Silicones by Walter Noll Academic Press, Index pp. 685,686,691–693.

The Journal of Photographic Science, Vol. 18, No. 1, Jan.–Feb. 1970, pp. 4–7, Uhlig.

*Primary Examiner*—Clyde I. Coughenowr

*Attorney, Agent, or Firm*—James J. Ralabate; James P. O'Sullivan; Donald M. MacKay

[57] ABSTRACT

A process is provided for forming waterless lithography printing masters comprising depositing a particulate image pattern on a non-tacky rubbery uncured silicone polymer, converting the non-tacky polymer into a softened gummy state and curing said softened polymer to fix the toner thereto.

20 Claims, 4 Drawing Figures

PROCESS FOR PREPARING REVERSIBLE CURE WATERLESS LITHOGRAPHIC MASTERS

BACKGROUND OF THE INVENTION

In conventional offset lithography, a printing master is employed with an oleophilic image pattern on a hydrophilic and oleophobic background. An oil based printing ink as well as a water based fountain solution are fed from suitable roller applicators. The fountain solution serves to wet the background areas so that the ink is accepted only in the image areas. The quality of printing tends to a great extent upon maintaining a suitable balance between the amounts of ink and fountain solution fed as well as preventing emulsification between the ink and fountain solution and also maintaining the hydrophilic/hydrophobic character of the printing plate throughout its working life. Because it is difficult to maintain optimum printing conditions, methods have been sought to overcome these difficulties inherent in conventional lithography.

It has recently been discovered that the requirement for a fountain solution can be obviated by employing a planographic plate having a silicone elastomeric layer. Because the silicone is not wetted by the printing ink, no fountain solution is required. Since conventional offset lithographic masters can be rapidly and inexpensively imaged by electrostatographically depositing and fusing a particulate image pattern, with ink receptive particles commonly referred to as "toner", it has been attempted to make waterless lithographic masters by a similar process. It has been found however, that the very properties that make silicone elastomers reject printing ink also make them reject other materials such as melted toner. A method developed to more firmly adhere the toner to the silicone is to deposit the toner image on a layer of silicone gum and then cure the silicone to an ink releasing elastomeric condition. While this method can produce excellent printing masters it is not well suited for the preparation of nonimaged masters which can be stored for extended periods prior to imaging. This is because virtually everything will adhere to the silicone gum, including dust from the atmosphere, thereby creating contaminated areas and potential background areas of the master which can provide ink receptive sites and therefore yield prints with unacceptable background. Further, silicone gum masters have a tendency to adhere to photoreceptive surfaces making it difficult to effect a clean transfer of toner images. In addition, packaging of silicone gum masters is difficult since contact with other surfaces may damage the soft coating. Finally, chemically reactive sites on the silicone gums available for crosslinking may also be attacked by components of the atmosphere leading to premature curing and making the resultant rubber unsuitable for toner adhesion. It is to this problem of providing storable nonimaged waterless lithographic masters to which this invention is directed.

DETAILED DESCRIPTION OF THE INVENTION

Figure 1:
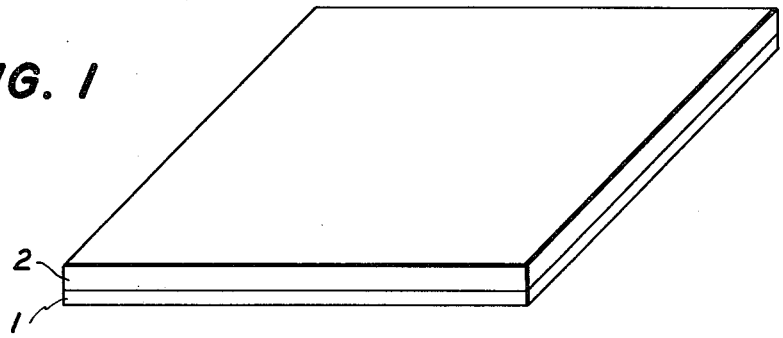
FIG. 1 depicts the formed printing master of the invention and its structure.

It has now been discovered that a nonimaged printing master can be prepared having a long shelf life if the silicone gum is converted to a non-tacky rubbery uncured silicone polymer. Further, it has been discovered that a particulate image pattern can be deposited thereon, either directly from a photoreceptor surface or from an intermediate transfer member, the silicone polymer converted into a softened gummy state so as to embed toner therein, and the polymer cured to an elastomeric ink releasing condition whereby the toner is firmly fixed thereto. It has additionally been found that the particulate image pattern can be removed after curing of the gum to provide depressions corresponding to the particulate image pattern so that printing can be accomplished from these depressions which are ink accepting.

More particularly, it has been found that silicone gums can be converted to an elastomeric but uncrosslinked condition, whereby they are mechanically and chemically stable to storage as thin films on a suitable substrate, until imaging is desired. Because of the nongummy condition of the polymer, it can be stored indefinitely without becoming contaminated and a particulate image pattern can be deposited either directly from the photoreceptive surface or from an intermediate transfer member without contamination of nonimage areas. The polymer can then be reconverted to a gummy uncured state whereby toner can be adhered thereto or embedded therein as is the case when toner is deposited on an uncured silicone gum. Then the gummy polymer can be cured to a highly elastomeric but ink releasing silicone rubber from which prints can be made for extended periods without any apparent degradation.

To operate the printing master according to the process of the invention, a suitable substrate is first coated with an uncured silicone gum containing reactive pendant groups.

Substrates which can be employed to prepare the printing master are self-supporting materials to which the silicone can be adhered and which possess sufficient heat and mechanical stability to permit use under widely varying printing and handling conditions, and which are preferably ink accepting. Exemplary of suitable materials are paper; metals such as aluminum; and plastics such as polyester, polycarbonate, polysulfone, nylon or polyurethane.

The silicone gums which can be employed to coat the substrate are the conventional types employed heretofore in waterless lithography, which have reactive crosslinking sites or are capable of being cured to an ink releasable elastomeric condition. Exemplary of suitable silicone gums are those having only methyl containing groups in the polymer chain such as polydimethylsiloxane; gums having both methyl and phenyl containing groups in the polymer chain as well as gums having both methyl and vinyl groups, methyl and fluorine groups, or methyl, phenyl and vinyl groups in the polymer chain. Typical pendant groups through which crosslinking can occur include hydroxyl, amino, isocyanate and thioisocyanate groups.

Typical silicone gums suitable for use in the invention are thermally curable gums, having amino alkane crosslinking sites in the polymer backbone, sold by Union Carbide Corporation under the designation Y-3557 and Y-8053 silicone gums.

In preparing the printing master, a suitable silicone gum as described, containing pendant reactive groups suitable for crosslinking reactions, is blended with a blocking agent (capping or complexing agent) to convert the gum to a nontacky elastomeric but uncured condition as disclosed in U.S. Pat. No. 3,878,168. A variety of blocking agents can be employed and reacted by conventional methods. For example, gums having pendant amino groups can be reacted with a) an organohalosilane to form a silylamine, b) an organodiisothiocyanato silane to form a silylthiourea, c) an organoisocyanate to form a urea, d) phosgene to form an isocyanate group which can then be blocked with an oxime, e) a hydroxyorganoaldehyde to form an anil and f) an organoisothiocyanate to form a thiourea. Similarly, silicone gums containing pendant hydroxyl groups can be reacted with an isocyanate to form a urethane; gums with pendant isocyanate groups can be reacted with a diamine to form a urea and gums with thioisocyanate groups can be reacted with a diamine to form a thiourea. A variety of solvents can be employed for the reaction between the blocking agent and the silicone gum. It is only necessary that the reactants be at least partially soluble therein. Exemplary of typical solvents are toluene, benzene, tetrahydrofuran, dimethylsulfoxide, dimethylfuran, chlorobenzene, dioxime, chloroform, trichloroethylene and the like. In a preferred embodiment, a crosslinking agent is incorporated into the silicone gum-solvent solution after the reactive pendant groups of the gum have been blocked. The crosslinking agent must be one which is unreactive at low temperature or it must be blocked so that it is stable at low temperature. Typical blocked crosslinking agents are the phenol and oxime adducts of diisocyanates. Typical diisocyanates are toluene-2,4-diisocyanate, 4,4'-diisocyanato-diphenylmethane, 4,4'-diisocyanato-3,3'-dimethylbiphenyl, poly(m-methylene-p-isocyanatotoluene), hexamethylene diisocyanate, bis(2-isocyanato ethyl)-fumarate and tris(2,isocyanatoethyl)trimellitate. Typical blocking agents include alcohols such as ethanol; phenols such as phenol; silanols such as trimethylsilanol and oximes such as acetone oxime.

The blocked isocyanates are prepared by simply mixing together the blocking agent and polyisocyanate and if necessary warming the mixture gently for a short period of time. A mutual solvent is preferably employed and to avoid the presence of any free isocyanate groups it is advisable to employ a slight excess of the blocking agent.

When a silicone gum is employed having pendant isocyanate or thioisocyanate groups, a conventional diamine crosslinking agent can be employed. Exemplary of suitable diamines are ethylene diamine, phenylene diamine and dianiline. When it is desired to incorporate the diamine crosslinking agent into the silicone gum-solvent solution, the silicone gum should be first blocked with one of the aforesaid blocking agents.

The blocked silicone gum-solvent solution can also contain a compound that is capable of nucleophilic attack on a linking group at elevated temperature so as to remove the linking group by chemical reaction. Such a group is referred to herein as a "nucleophile". Typical nucleophiles for the silicone gums having pendant amino groups which were reacted with an organohalosilane to form a silylamine include alcohols such as ethanol; phenols such as phenol and oximes such as acetone oxime. The silicone gums with pendant hydroxyl groups which have been reacted with an isocyanate to form a urethane can be reacted with a nucleophile such as a monofunctional amine. Typical examples include aniline and toluidine. Silicone gums with pendant isocyanate or thioisocyanate groups which have been reacted with a monofunctional alcohol such as ethanol or phenol to form a urethane or a thiourethane can likewise be treated with a monofunctional amine nucleophile such as aniline and toluidine. Silicone gums with pendant isocyanate and thioisocyanate groups which have been blocked with a diamine to form a urea are more easily reconverted to their gummy state by heat.

The blocked silicone-solvent solution which may contain a nucleophile and crosslinking agent is then coated upon a suitable substrate by conventional means such as draw bar coating and the silicone film allowed to dry. Drying can be conveniently conducted at room temperature or slightly elevated temperature, but the temperature must not be sufficient to activate curing of the silicone. The solvent is evaporated during the drying operation and a non-tacky silicone film is formed which is resistant to aging, mechanical and chemical attack and into which dust, dirt and the like is not imbedded.

When it is desired to image the silicone coated substrate, a particulate image pattern can be deposited by conventional means. A preferred method of imaging involves the basic xerographic process which comprises depositing a uniform electrostatic charge on a photoconductive insulating layer, exposing the layer to a light and shadow image to dissipate the charge on the areas of the layer exposed to the light and developing the resultant electrostatic latent image by depositing on the image, a finely-divided electroscopic imaging material referred to in the arrt as "toner". The conventional toners can be employed which typically are thermoplastic materials such as polymers of styrene, vinyl chloride and the like in combination with a pigment such as carbon black. Exemplary of suitable styrene polymers are polystyrene, styrene-n-butylmethacrylate copolymer and styrene-butadiene copolymer. The image can be developed on a separate photoconductive surface and transferred to the silicone by electrostatic transfer or similar means or by employing a photoconductive substrate, the image can be formed and developed on the silicone. The particular method of imaging, developing and the toner employed comprise no part of the invention and thus the conventional methods and materials can be employed.

In order to cause the toner to adhere to the silicone and become imbedded therein, the nontacky, rubbery silicone polymer is converted into a softened gummy state. Softening or conversion to the gummy state can be accomplished by a number of means, the selection of which depends upon the type of blocking group on the silicone gum. For example, urea blocked gums can be softened by heating the silicone whereby the silicone first becomes soft and then cured if a crosslinking agent was incorporated therein, to firmly bond the toner to the silicone. Where the silicone contains a nucleophile, the silicone can be rendered gummy by heating it to cause a chemical displacement reaction. Alternatively, the silicone may be subjected to a nucleophile vapor or the blocked silicone can be rendered gummy by treatment with a solvent such as toluene, benzene and the like, such as is employed to initially coat the silicone on a substrate. The gummy toner imaged silicone is then ready for final curing.

The gummy silicone can then be cured by conventional means. For example, those gums containing a blocked-diisocyanate or diamine incorporated therein can be cured by simply heating the gum at an elevated temperature. Gums containing no cross-linking agent can be cured by subjecting the gum to a vapor such as diisocyanate vapor. Finally gums which were previously softened merely by the addition of heat, may be cured by merely lowering the temperature to reform or convert it to its previous elastomeric state.

After curing, the master can be immediately employed for printing or the particulate image pattern can be first removed to provide ink receptive depressions corresponding to the morphology of the deposited particulate image pattern. Removal can be accomplished by washing with a solvent such as acetone to remove substantially all of the toner particles from the image areas, but not dissolve the silicone thereby revealing a porous image corresponding to the deposited toner pattern. Many other conventional solvents can be employed.

Figure 2:
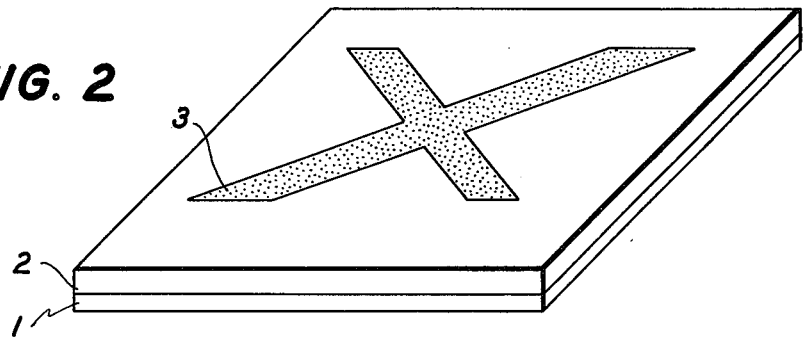
FIG. 2 depicts the printing master of the invention imaged with a deposited particulate image pattern.
Figure 3:
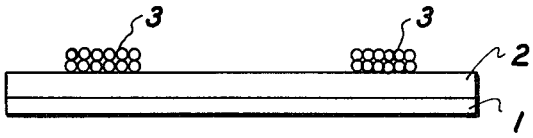
FIG. 3 illustrates a side view of the printing master of the invention after deposition of the particulate image pattern.
Figure 4:
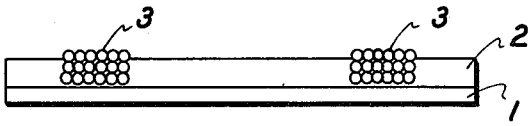
FIG. 4 illustrates a side view of the printing master of the invention after the deposited particulate image pattern is made permanent for printing purposes.

The silicone masters are ink releasing in the nonimaged areas and can thus be employed on a direct or offset printing press with conventional inks to provide prints over a long period of operation, without the requirement of a fountain solution. Referring to FIG. 1, 1 is a substrate such as aluminum and 2 is the silicone coating. A particulate image material in image configuration is shown in FIG. 2 as 3. In FIG. 3 the side view of the particulate imaging material 3 is shown prior to curing of the silicone and in FIG. 4 the particulate imaging material is shown after curing of the silicone partly recessed below the surface of the polymer coating.

The following examples are illustrative of the invention and preferred embodiments. All parts and percentages in said examples and elsewhere in the specification and claims are by weight unless otherwise specified.

EXAMPLE I

A printing master was prepared as follows. Thirty grams of a 10 percent weight solution of poly (dimethyl siloxane) silicone gum (Union Carbide Y-3557) in benzene (which has 1.5 weight percent of aminobutylmethylsiloxane pendant sites and a molecular weight from 200,000 to 500,000) was mixed with 0.04 gram of dimethyl dichlorosilane (capping agent in an amount excess to the pendant amino groups of the silicone gum) and blended by stirring in an open beaker. To this mixture was added 0.6 gram of a 5 weight percent solution in tetrahydrofuran of the acetone oxime adduct of toluene-2,4-diisocyanate. The resultant solution was draw bar coated on a 10 inches × 15 inches aluminum sheet. The solvent was allowed to evaporate by maintaining the coated sheet at room temperature for 1 hour and the coating was found to be dry to the touch resembling an elastomeric polymer rather than a gum. The thickness of the film when dry was between 6 and 8 microns.

Thereafter using a Xerox Model D processor, an electrostatic latent test image was formed and cascade developed with Xerox 2400 toner, after which the developed image was electrostatically transferred to the surface of the coated sheet. The sheet was then placed in a Xerox vapor fuser containing air saturated with ethyl alcohol and then maintained therein at room temperature for a period of one minute. The sheet was then removed from the vapor fuser and placed in an air oven maintained at 175°C and placed in intimate contact with a metal shelf of the oven. After a period of 5 minutes, the sheet was removed from the oven and allowed to cool to room temperature. The silicone coating was found to have been converted to a tough highly elastomeric polymer and the toner image was found to have become bonded to the silicone polymer as the toner could not be removed by adhesive tape. The sheet was then mounted on the master cylinder of a Davidson Duo Lithographic Printing Press with the fountain train removed. Employing a rubber based black ink (VanSon-Holland Ink Co. No. 10850) the press was operated in the offset mode to produce 1000 paper copies with clear sharp impressions and good contrast and with negligible ink contamination in the nonimage areas. The press was operated in the direct mode and another 1000 copies of similar quality were obtained.

EXAMPLE II

In accordance with the procedure of Example I, a printing master was prepared and prints made therefrom using the materials of Example I. After printing several thousand copies, the master was removed from the press and found to have no appreciable wear. The plate was then wiped with acetone, a solvent for both the toner and ink but not deleterious to the silicone rubber for the purpose of removing the toner. It was found that the image areas contained depressions corresponding to the morphology of the particulate toner. The master was then remounted on the press and 1000 clear copies obtained in both the offset and direct printing modes.

EXAMPLE III

The procedure of Example I was repeated but for the exception that the toner employed consisted of poly (alpha methylstyrene) with 5 percent carbon black. It was found that during the printing operation, toner was removed from the master and that after 200 paper impressions had been generated, the master was completely clear of toner. The master continued to generate excellent prints in both the offset and direct printing modes, however, as the toner shaped depressions continued to accept ink.

EXAMPLES IV–VI

In accordance with the general procedure of Example I, three printing masters were prepared and tested but for the exception that the masters contained one of the three following substrates as a substitute for the aluminum substrate: Xerolith 5 mil paper master stock (Xerox Corporation) 5 mil Mylar (EI DuPont Company) and aluminum coated paper (3M Company). Clean copies of good image contrast were obtained from each of the masters.

EXAMPLES VII–IX

In accordance with the general procedure of Example II, three printing masters were prepared each having one of the substrates of Examples IV–VI. Printed copies of excellent quality were obtained.

EXAMPLES X–XII

In accordance with the procedure of Example III, three printing masters were prepared using the substrate materials of Examples IV–VI. Copies of excellent quality were obtained from each master.

EXAMPLES XIII–XXIV

Printing masters were prepared and tested in accordance with the procedure of Examples I–XII, but for the exception that triphenyl chlorosilane was substituted for the dimethyl dichlorosilane capping agent to said examples. Good to excellent prints were obtained from all of the masters.

EXAMPLE XXV

The procedure of Example I was repeated but with the following exceptions. Instead of employing the ethyl alcohol nucleophile vapor softening step, an internal nucleophile (0.3 gram of meta-cresol) was added to the silicone gum solution and after deposition of the toner image, the master was heated in an oven at a temperature of 125°C for 60 seconds and then at 175°C for an additional 60 seconds. The toner image was found to be well adhered to the elastomeric silicone film of the master.

EXAMPLE XXVI

A printing master was prepared in accordance with the general procedure of Example I but for the exception that a diisocyanate vapor (toluene-2,4-diisocyanate) was substituted for the addition of the acetone oxime adduct of toluene-2,4-diisocyanate, and the coated sheet was subjected to the diisocyanate vapor for 3 minutes in a Xerox vapor fuser after the ethyl alcohol vapor treatment. The toner image was found to be firmly bonded to the cured silicone elastomer of the master.

EXAMPLE XXVII

A printing master was prepared as follows. Twenty grams of a 10 weight percent solution of silicone gum (Union Carbide Y-3557) in anhydrous benzene was blended with 0.04 gram of dimethyl diisothiocyanatosilane (excess amount based on the pendant amino groups of the silicone gum) in a closed container and allowed to react at 30°C for 1 hour. To this mixture was then added 0.4 gram of a 5 weight percent solution in tetrahydrofuran of the acetone oxime adduct of hexamethylene diisocyanate. The resultant solution was applied to a 10 inches × 15 inches aluminum sheet by a draw bar coating apparatus and allowed to air dry to evaporate the solvent. The dry film, 8 to 10 microns in thickness, was dry to the touch and elastomeric rather than gummy. Thereafter using a Xerox Model D processor, an electrostatic latent test image was formed and cascade developed using a poly ($\alpha$-methylstyrene) toner and electrostatically transferred to the surface of the silicone coated sheet. The master was then placed in an air oven maintained at 175°C in intimate contact with a metal shelf of said oven for a period of 2 minutes. The master was removed from the oven and allowed to cool to room temperature. It was found that the silicone gum had been converted to a tough elastomeric condition and the fused toner image could not be removed by adhesive tape. The master was mounted on a Davidson Duo Lithographic Press with the fountain train removed and inked with Ronico rubber base black ink (Ron Ink Co.). The press was operated in the direct mode to produce approximately 1000 prints having high image density and low background.

EXAMPLE XXVIII

A printing master was prepared as follows. To a 250 ml three necked flask equipped with a magnetic stirrer, thermometer, water condenser, drying tube and heating mantle was added 0.4 grams of 1-naphthyl isocyanate and 100.0 grams of a 10 weight percent solution of silicone gum in benzene (Union Carbide Corporation Y-8053) which gum has 1.5 weight percent of aminobutylmethylsiloxane pendant sites and a molecular weight from 200,000 to 500,000. The mixture was heated and agitated at a temperature between 45°–50°C for approximately 4 hours and then allowed to cool to room temperature. Twenty grams of this urea blocked silicone was blended with 0.8 grams of the acetone oxime adduct of toluene,2,4-diisocyanate (5 weight percent in tetrahydrofuran) and the mixture draw bar coated on a 10 inches × 15 inches aluminum sheet. The coated sheet was allowed to dry at room temperature to evaporate the solvent and the film of silicone when dry was between 6 and 8 microns thick. Employing a Xerox Model D processor, an electrostatic latent test image was formed and cascade developed using Xerox 2400 toner and electrostatically transferred to the surface of the silicone coating. The resultant master was then placed in an air oven maintained at 190°C in intimate contact with a metal shelf for a period of 2 minutes. The master was then removed from the oven and allowed to cool to room temperature. The silicone was found to have been converted to a tough elastomeric condition and the fused toner image adhered to the silicone surface such that no toner could be removed by adhesive tape. The master was mounted on a Davidson Duo Lithographic Printing Press with the fountain train removed and inked with Ronico rubber base black ink (Ron Ink Co.). The press was operated in the direct mode and produced good impressions with low background contamination.

EXAMPLE XXIX

A printing master was prepared as follows. One-hundred grams of anhydrous toluene was charged to a 250 ml. flask equipped with a dry ice condenser, dry ice cooling bath, magnetic stirrer, dropping funnel, sparge tube and thermometer. While the temperature of the toluene solvent was lowered to −10°C, anhydrous nitrogen was introduced through the sparge tube to prevent the toluene from becoming contaminated with water condensate. When the temperature of the toluene reached −10°C, 10 grams of phosgene gas was slowly bubbled into the toluene. While maintaining this temperature, 100 grams of a 10 weight percent solution of silicone gum (Union Carbide Y-3557) in toluene was added over a period of 20 minutes. An additional 5 grams of phosgene was added to the mixture and the temperature allowed to increase to room temperature. The flask was then fitted with a drying tube, the other equipment removed and the flask maintained at room temperature for 16 hours. Nitrogen was then sparged into the mixture to remove any unreacted phosgene, the solvent removed by heating under reduced pressure and the solids content adjusted to 10 weight percent by the addition of anhydrous toluene. A small portion of this sample was then tested for free amine by adding polymethylene polyphenylisocyanate. No gel formed indicating the absence of amine groups and the conversion of these groups to the desired isocyanate substituted silicone. Ten grams of this silicone was charged to a 50 ml. flask equipped with a magnetic stirrer, thermometer, heating mantle and drying tube. Acetone oxime (0.05 gram solvated in tetrahydrofuran) was added and the mixture heated at 35°C for approximately 3 hours to form the acetone oxime adduct and block the pendant isocyanate groups present in the silicone. Two grams of this solution was mixed with 0.05 gram of a 5 weight percent solution of methylene dianiline in tetrahydrofuran and draw bar coated on an aluminum sheet. The coated sheet was allowed to air dry at room temperature for approximately 1 hour. The film was found to be dry to the touch and crystals of dianiline were observed forming in the film. Employing a Xerox Model D processor, an electrostatic latent test image was formed and developed with Xerox 2400 toner and electrostatically transferred to the silicone surface. The resultant imaged plate was then placed in an air oven at 180°C for 2 minutes in intimate contact with a metal shelf. The resultant master was then removed from the oven and allowed to cool to room temperature where it was noted that the silicone was converted to an elastomeric condition and the fused toner image could not be removed by adhesive tape. The master was hand inked using Ronico rubber based black ink and prints were obtained having high density image areas with low background contamination.

EXAMPLE XXX

A printing master was prepared as follows. Thirty grams of a 10 weight percent solution of silicone gum (Union Carbide Y-3557) in benzene was blended with 0.015 gram of meta-hydroxy benzaldehyde in 5 cc of benzene. The solution was then heated to remove the water formed as a by-product of the reaction. The resultant silicone gum having pendant hydroxyl groups was blended with 0.015 gram of phenylisocyanate and heated at 30°to 35°for 5 hours to form urethano groups. The mixture was then blended with 0.6 gram of a 5 weight percent solution in tetrahydrofuran of the acetone oxime adduct of toluene-2,4-diisocyanate and the resultant mixture draw bar coated on an aluminum sheet. The sheet was allowed to air dry at room temperature to evaporate the solvent and a film of 8 to 10 microns in thickness resulted being quite dry to the touch. The sheet was then toner imaged, heated in an oven at 175°C for 2 minutes and inked in accordance with the general procedure of Example XXIX. Copies were obtained employing this master having good image density and low background contamination.

EXAMPLE XXXI

A printing master was prepared in accordance with the general procedure of Example XXVIII with the exception that the silicone gum was reacted with 1-naphthyl isothiocyanate in place of the 1-naphthyl isocyanate and high quality prints were again obtained.

EXAMPLE XXXII

A series of printing masters were prepared in accordance with the general procedure of Example I but for the exception that the silicone gum was reacted with bis-dimethyl-amino diphenylsilane, instead of dimethyl dichlorosilane. The masters were stored under a plastic slip sheet of from one day to 12 months before imaging and good to excellent prints were obtained from all of the resultant imaged masters.

EXAMPLE XXXIII

A series of printing masters were prepared in accordance with the general procedure of Example I but for the exception that the silicone gum was reacted with bis-dimethyl amino dimethylsilane instead of dimethyl dichlorosilane. The masters were stored for varying periods of from 1 day to 12 months prior to imaging and good to excellent prints were obtained from the resultant imaged masters.

EXAMPLE XXXIV

A series of masters were prepared in accordance with the general procedure of Example I but for the exception that the silicone gum was reacted with diphenyl dichlorosilane instead dimethyl dichlorosilane. The masters were stored for varying periods of 1 day to 6 months prior to imaging under a plastic slip sheet and good to excellent printing results were obtained in all samples from the resultant imaged masters.

EXAMPLE XXXV

A series of printing masters were prepared in accordance with the general procedure of Example I but for the exception that the silicone gum was reacted with trimethyl chlorosilane instead of dimethyl dichlorosilane. The masters were stored under a plastic slip sheet for varying periods of 1 day to 4 months prior to imaging and good prints were obtained from the resultant image masters.

EXAMPLE XXXVI

A series of printing masters were prepared in accordance with the general procedure of Example I but for the exception that the silicone gum was reacted with phenyl trichlorosilane instead of dimethyl dichlorosilane. The masters were stored under a plastic slip sheet for varying periods from 1 day to 2 months in duration prior to imaging and prints of good quality were obtained on all of the resultant imaged masters.

EXAMPLE XXXVII

A series of printing masters were prepared in accordance with the general procedure of Example I but for the exception that the silicone gum was reacted with linear octamethyl dichlorotetrasiloxane instead of dimethyl dichlorosilane. The masters were stored under a plastic slip sheet for varying periods from 1 day to 3 months prior to imaging and good prints were obtained from the resultant imaged masters.

EXAMPLE XXXVIII

Two printing masters were prepared in accordance with the general procedure of Example XXVIII but for the exception that the silicone gum was reacted with phenyl isothiocyanate and phenyl isocyanate, respectively in place of 1-naphthyl isocyanate. Prints of fair quality were obtained.

EXAMPLE XXXIX

A printing master was prepared as follows. To a 100 ml. three necked flask equipped with a magnetic stirrer, thermometer, heating mantle and drying tube, was charged 50 grams of a 10 weight percent solution of poly (dimethylsiloxane) silicone gum (Union Carbide Y-8053) in benzene which gum has 1.5 weight percent of aminobutylmethylsiloxane pendant sites and a molecular weight of from 200,000 to 500,000. The mixture was heated to 45°C and agitated for approximately four hours and then allowed to cool to room temperature. A small portion was removed and tested for the presence of free amino groups by adding several drops of polymethylene polyphenyl isocyanate but no gel occurred, indicating that the amine groups had been blocked by reaction with the monofunctional isocyanate. Another small portion of the silicone solution was placed on a metal plate and allowed to dry at room temperature. After the solvent evaporated, a dry elastomeric film was formed. A 10 inches × 15 inches aluminum substrate was then draw bar coated with the above silicone solution to which had been blended a stoichiometric quantity of the acetone oxime adduct of toluene, 2,4-diisocyanate curing agent. The plate was allowed to dry at room temperature to a film thickness of 6 to 8 microns. The plate was then imaged, developed and the silicone cured in accordance with the general procedure of Example I but for the exception that the curing temperature was 180°C for two minutes. The master was mounted on a Davidson Press employing Ronico Rubber Base Lithographic Ink and 1250 clean copies were made with high image density and low background contamination.

Having described the invention with reference to these specific embodiments, it is to be understood that numerous variations can be made without departing from the spirit of the invention, and it is intended to encompass such reasonable variations or equivalents within its scope.

What is claimed is:

1. A process for preparing a printing master comprising, providing a non-tacky rubbery uncured silicone polymer, forming a particulate image pattern, depositing said particulate image pattern on said non-tacky rubbery uncured silicone polymer, converting the non-tacky polymer into a softened tacky uncured state thereby adhering the particulate image pattern and curing said softened polymer to fix the particulate image pattern thereto.

2. The process of claim 1 additionally comprising removing the particulate image pattern after curing to provide an ink receptive image corresponding to the deposited particulate image pattern.

3. A process of printing with the master as set forth in claim 2 wherein following the removal of the particulate image pattern, ink is applied to the resultant depressions corresponding to the particulate image pattern of the master and the resultant master contacted with an image receiving surface to thereby transfer the inked image.

4. A process of printing with the master as set forth in claim 1 wherein following the curing to fix the particulate image pattern, ink is applied to the particulate image pattern of the master and the resultant master contacted with an image receiving surface to thereby transfer the inked image.

5. A process for preparing a printing master comprising:

a. providing a suitable substrate;
b. providing an uncured silicone gum containing reactive groups through which crosslinking can occur, said groups being present in a minor effective amount sufficient to render the gum elastomeric when cured;
c. coating said substrate with said gum;
d. converting said uncured gum into a rubbery non-tacky uncured silicone polymer;
e. forming a particulate image pattern;
f. depositing said particulate image pattern on the surface of said non-tacky polymer;
g. converting said non-tacky polymer into a softened tacky uncured state thereby adhering the particulate image pattern; and
h. curing the tacky polymer to a non-tacky ink releasable condition and thereby fixing the particulate image pattern.

6. The process of claim 5, additionally comprising removing the particulate image pattern after curing to provide an ink receptive image corresponding to the deposited particulate image pattern.

7. The process of claim 5 wherein the non-tacky polymer is converted into a softened gummy state by a nucleophile vapor.

8. The process of claim 5 wherein the substrate is coated with an uncured silicone gum-solvent solution containing a blocked diisocyanate crosslinking agent.

9. The process of claim 5 wherein the substrate is coated with an uncured silicone gum-solvent solution containing a nucleophile.

10. The process of claim 5 wherein an electrostatic latent image is formed, developed with a particulate imaging material and the image electrostatically transferred to the surface of said non-tacky polymer and fused thereon.

11. The process of claim 5, wherein the uncured silicone gum contains pendant amino groups and the gum is converted to a rubbery non-tacky state by reaction with a capping agent.

12. The process of claim 11, wherein the non-tacky layer is converted into a gummy state by reaction with a nucleophile.

13. The process of claim 12 wherein the nucleophile is selected from alcohols, phenols and oximes.

14. The process of claim 11 wherein the capping agent is an organohalosilane.

15. The process of claim 11 wherein the capping agent is an organoisocyanate.

16. The process of claim 11 wherein the capping agent is phosgene followed by acetone oxime.

17. The process of claim 11 wherein the capping agent is a hydroxy organoaldehyde.

18. The process of claim 11 wherein the capping agent is an organoisothiocyanate.

19. The process of claim 11 wherein the silicone is cured with a diisocyanate.

20. The process of claim 5 wherein the non-tacky polymer is converted into a softened gummy state by heat.

* * * * *